United States Patent [19]

Staar

[11] Patent Number: 5,069,232

[45] Date of Patent: Dec. 3, 1991

[54] DISPOSABLE MAKE-UP SYSTEMS

[75] Inventor: Marcel J. H. Staar, Brussels, Belgium

[73] Assignee: Staar Development Company S.A., Brussels, Belgium

[21] Appl. No.: 594,563

[22] Filed: Oct. 5, 1990

Related U.S. Application Data

[63] Continuation-in-part of Ser. No. 417,330, Oct. 5, 1989, abandoned.

[30] Foreign Application Priority Data

Oct. 5, 1988 [BE] Belgium ..... 08801140

[51] Int. Cl.[5] ..... A45D 40/26

[52] U.S. Cl. ..... 132/320; 401/96; 401/97; 401/98; 206/581; 132/318

[58] Field of Search ..... 132/317, 318, 320; 401/88, 89, 95, 96, 97, 98; 206/229, 385, 519, 581, 823; 15/184

[56] References Cited

U.S. PATENT DOCUMENTS

| | | | |
|---|---|---|---|
| 940,797 | 11/1909 | Fraser | 401/96 |
| 2,414,245 | 1/1947 | Rudd | 132/318 |
| 2,471,483 | 5/1949 | Frydlender | 401/86 |
| 2,953,142 | 9/1960 | Clementson | 206/385 |
| 4,711,354 | 12/1987 | Bennett | 206/385 |
| 4,915,234 | 4/1990 | Boeller | 132/320 |

FOREIGN PATENT DOCUMENTS

| | | | |
|---|---|---|---|
| 0315937 | 5/1989 | European Pat. Off. | 401/98 |
| 2818180 | 11/1978 | Fed. Rep. of Germany | 401/98 |
| 1270008 | 7/1961 | France | 132/318 |
| 595565 | 7/1959 | Italy | 401/98 |
| 687035 | 2/1953 | United Kingdom | 401/97 |

*Primary Examiner*—John J. Wilson
*Assistant Examiner*—Frank A. LaViola
*Attorney, Agent, or Firm*—Robert W. Becker & Associates

[57] ABSTRACT

Conditioning system for lip rouge or make-up is provided. The system has two parts which are engageable with each other, with one of the parts being adapted to carry the required quantity of the product which is deposited as a layer by dipping, and the other part being adapted to form a closure of the system or to increase its total length.

18 Claims, 1 Drawing Sheet

DISPOSABLE MAKE-UP SYSTEMS

This is a continuation-in-part application of Ser. No. 417,330 filed Oct. 5, 1989, now abandoned.

FIELD OF THE INVENTION

The present invention relates to disposable make-up systems and more particularly to miniature lipsticks which may be produced parallel in large quantities, having a cover which is used for increasing the lengths of a handle at the time of use.

BACKGROUND OF THE INVENTION

U.S. Pat. No. 4,602,650 discloses a liquid applicator intended for applying coats of paint or the like by a device mounted on a person's finger or hand. This applicator comprises a generally cylindrically shaped mounting sleeve which is attached at one end to an applicator head.

According to one example this applicator is made from a rigid thimble-shaped applicator head and a mounting sleeve tightly fixed to this applicator head and being made from surgical rubber, in order to accommodate many different sizes of user's fingers According to this example, the mounting sleeve can be rolled wrong side out over the applicator head and the brush tip thereof. As the rolled edge 16 of the mounting sleeve is still open, drying-out of the brush cannot be prevented.

According to another example of this construction, the mounting sleeve is detachably attached to the applicator head such that different relative positions between mounting sleeve and applicator head may be provided.

This applicator system would in general be also usable for disposing make-up. However, if a mounting sleeve is turned inside out by rolling it over an applicator head, no complete cover of the applicator head can be provided such that drying-out cannot be prevented.

Moreover, if the applicator head touches the mounting sleeve, the respective part thereof would become soiled. If rolled back again to the normal position, the soiled part of the mounting sleeve would be on the outer portion thereof such that it is open to further soil different parts. Correspondingly, the construction known from U.S. Pat. No. 4,602,650 requires that it be cleaned after use which is not possible with make-up systems.

From U.S. Pat. No. 2,953,142 it is known to provide a lipstick assembly having a handle portion marked with the reference number 10, a holder section 11 and an applicator 12. If not in use, the holder section 11 and the applicator 12 are covered by means of a closure cap 14. At the time of use, this closure cap 14 is put aside such that the applicator is free for using it. The person using the lipstick assembly may hold the single lipstick at the part indicated by reference number 10 which is named closure section and which also may be used as a closure cap for a further lipstick.

This known lipstick assembly is relatively long when stored away, such that it is not suitable for women's small purses or vanity-bags.

Another problem of this lipstick results from soiling the applicator head—which is laid open at the time of use and is subject to being touched by the person handling the lipstick. If the cover 14 is put on the applicator head and the lipstick holder, soiling of the outer surface of holder section or stud 11 would occur unless the cover is moved exactly coaxially to the applicator head.

In practice, the holder section or stud 11 can be soiled such that also soiling of the user's fingers will result.

This soiling mainly occurs when the lipstick is moved along the user's lips as then it is not possible to control the finger gripping position visually.

In view of the above, it is an object of the present invention to provide an improved and cheap disposable make-up system which helps in preventing a user's fingers from being soiled when using the lipstick and applying lipstick color to her lips.

A further object of the present invention is to provide means for increasing the length of the handle portion of the lipstick at the time of use only.

Another object of the present invention is to provide means for decreasing the overall length of a disposable make-up system at the time of non-use such that this length is much less than double the gripping length.

Another object of the present invention is to provide a disposable make-up system which is easy to produce and yet meets necessary quality standards and avoids damaging the image of the trade mark of the manufacturing company.

Another object of the present invention is to provide a system which permits the manufacturing of a large quantity of systems which may be arranged in groups and handled as a whole until the time when they are packed and when they are separated.

Another object of the present invention is to provide means for limiting the drying-up of conditioned volatile products until they are used by the customer.

SUMMARY OF THE INVENTION

In order to realize these objects, a system is proposed which in general consists of a base part and a combined cover and handle part, where the base part comprises an applicator portion, a guide portion and a tubular portion of enlarged diameter, said tubular portion of enlarged diameter having an inner cavity being open at one end distal to the applicator portion, and where said combined cover and handle portion comprises a tubular portion adapted to be slidable on that guide portion of that base part, and further comprising a reduced diameter portion having an outer diameter which is adapted to fit into said cavity and having an inner diameter which is adapted to fit on said applicator portion.

Means are provided for allowing the reduced diameter portion to receive the applicator portion at the time of non-use or in a closed position of the disposable make-up system.

Further means are provided to allow the reduced diameter portion to fit into the tubular portion of enlarged diameter of said base part, and said cavity thereof, at the time of use or in an open position.

Further means are provided for receiving the applicator portion in said reduced diameter portion, said applicator portion having a predetermined maximum diameter which is reduced over the lifetime of the disposable make-up system due to the consumption of said lip rouge, said diameter being smaller than the diameter of a recess or compartment provided in said reduced diameter portion for receiving said applicator portion, said recess having an inner diameter which is essentially constant over the length of the reduced diameter portion and allows the applicator portion to fully be inserted into said recess.

BRIEF DESCRIPTION OF THE DRAWINGS

The object and advantages of the present invention will appear more clearly from the following description in conjunction with the accompanying drawings, in which.

DESCRIPTION OF PREFERRED EMBODIMENTS

Figures 1A, 1B, 1C, 1D, 1E, 1F:
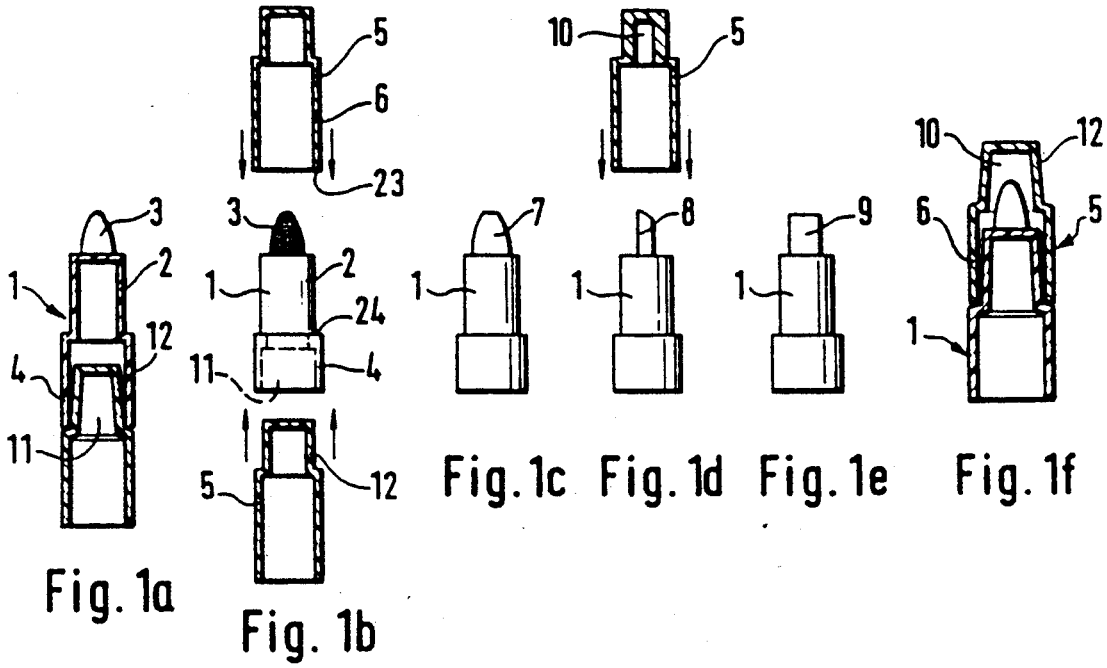
FIGS. 1*a–f* are exploded views showing several alternative shapes, of the inventive system.

In order to make the invention better understandable, the following non-limiting examples are given:

FIG. 1 shows an inventive system comprising a base part 1 which is preferably injection-molded from a plastic material and contains a guide portion 2, an applicator portion 3 and a tubular portion of enlarged diameter 4, further comprising a combined cover and handle part 5 which likewise is injection-molded from a transparent plastic material and has a tubular portion 6 and a reduced diameter portion 12.

In detail, the base part 1 at its tubular portion of enlarged diameter 4 comprises a cavity 11 which is adapted to receive the reduced diameter portion 12 of the combined cover and handle part 5.

Both the outer diameter of the reduced diameter portion 12 and the inner diameter of cavity 11 may be slightly conical in order to form a rigid connection between the base part 1 and the combined cover and handle part 5. The overall length of the tubular portion of enlarged diameter 4 is selected to have a length which may be gripped easily between two fingers at the time of putting the combined cover and handle part 5 and the reduced diameter portion 12 thereof into the base part 1 and the tubular portion of enlarged diameter 4 thereof, and also when removing said connection between said parts 1 and 5.

On the other hand, the overall length of the reduced diameter portion 12 of the combined cover and handle part 5 is selected to have an inner length which is sufficient for receiving the applicator portion 3 but not extending much beyond said portion. By this step, the overall length of the disposable make-up system at the time of non-use is additionally decreased, and also the volume of air surrounding the applicator portion 3 in the closed position of the disposable make-up system is reduced such that any volatile product escaping from a lip rouge or the like applied to said applicator portion 3 would be kept in a small compartment.

The applicator portion 3 may have a suitable shape depending on the product to be conditioned, e.g. a shape 7 for lip rouge, a shape 8 for covering eye-lashes, and a shape 9 for cheek make-up.

Correspondingly, the compartment 10 provided in said reduced diameter portion 12 of the combined cover and handle part 5 may be adapted to the shape of the specific portion in order to reduce the volume of air that is in contact with the conditioned product.

The operation of the inventive disposable make-up system when soiling the cover will now be described. If not used properly, the inner surface of the tubular portion 6 of the combined cover and handle part 5 may sometimes come in contact with the conditioned product being applied to said applicator portion 3. This may happen when the inventive disposable make-up system is brought into the closed position as well as when the combined cover and handle part 5 covering the base part 1 is taken off this base part 1 without keeping both parts coaxially to each other during the time of relative movement of each other.

At this time, the inner surface of the tubular portion 6 of the combined cover and handle part 5 will become soiled. Usually, the user will put the parts 1 and 5 together in the used position as may be taken from the left part of FIG. 1. At this time, the lip rouge or the like soiling will be within the inner surface of the tubular portion 6 of the combined cover and handle part 5 which now forms a handle.

However, at the next time of closure of the inventive make-up system, the lip rouge which is received on the inner surface of the tubular portion 6 will, due to the contact between this inner surface and the outer surface of this guide portion 2 of base part 1, spread over the outer surface of guide portion 2.

Again, at the next time of use the user would then take out the base part 1 off the combined cover and handle part 5 in order to again apply lipstick, rouge or the like to her lips. She then, however, will not touch the now soiled outer surface of guide portions 2 as the length of the tubular portion of enlarged diameter 4 is sufficient for gripping by means of two fingers, in order to bring the inventive disposable make-up system into the open position as shown in the left part of FIG. 1.

In this position, the tubular portion 6 will extend the handle length available for gripping with more than two fingers as its outer diameter corresponds to the outer diameter of the tubular portion of enlarged diameter 4 of base part 1. Thus, when applying the lip rouge, there will be sufficient gripping length without having to come into contact with the—soiled—guide portion 2. This is essential as at this time the user usually would pay less attention to her fingers but mainly try to carefully apply the lip rouge to her lips.

Thus, by this telescopic arrangement it is possible to provide a lipstick means or a disposable make-up system which has a small overall length at the time of non-use, i.e. in the closed position shown on the right part of FIG. 1, and yet to provide a lipstick having a sufficient handle length in the open position as shown in the left part of FIG. 1.

Means are provided for preventing soiling of the user's fingers, even in an indirect manner. Yet the disposable make-up system according to the invention may be manufactured easily and in an extraordinarily cheap manner.

The shape of the applicator portion 3 which may have the shape 7, 8, 9 determines the surface of the product, and the thickness of its layer obtained by hot-dipping is partially controlled by the cast thickness of the applicator portion being a greater or smaller thermal lag which more or less rapidly causes the layer of the product to solidify.

The pieces are shaped and remain in large groups, and are advantageously handled as an entity during the different manufacturing steps.

The pieces remain in groups directly in a portion 13 of the mold in which cavities or grooves 14 may be provided so that they can be very easily separated afterwards.

Figure 2:
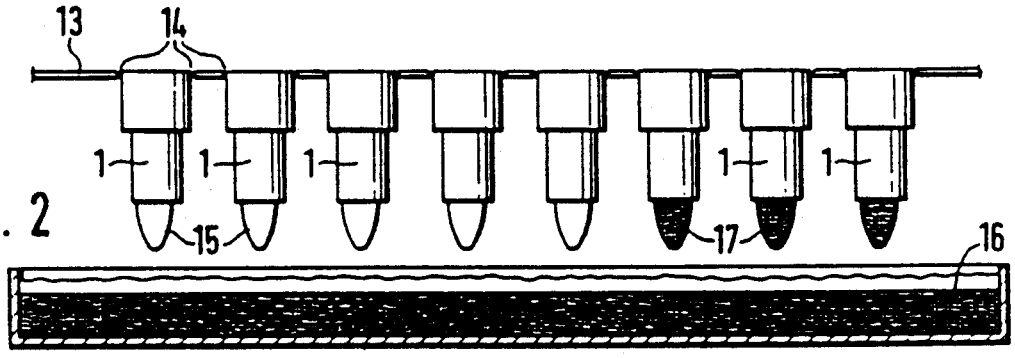
FIG. 2 shows a group of the inventive systems and how they are provided with a product film.

FIG. 2 shows a cross-section of a group of 64 units. The portions of the specific shapes 15 are all dipped in the liquified product 16 which forms a film 17 having a certain thickness.

Figure 3:
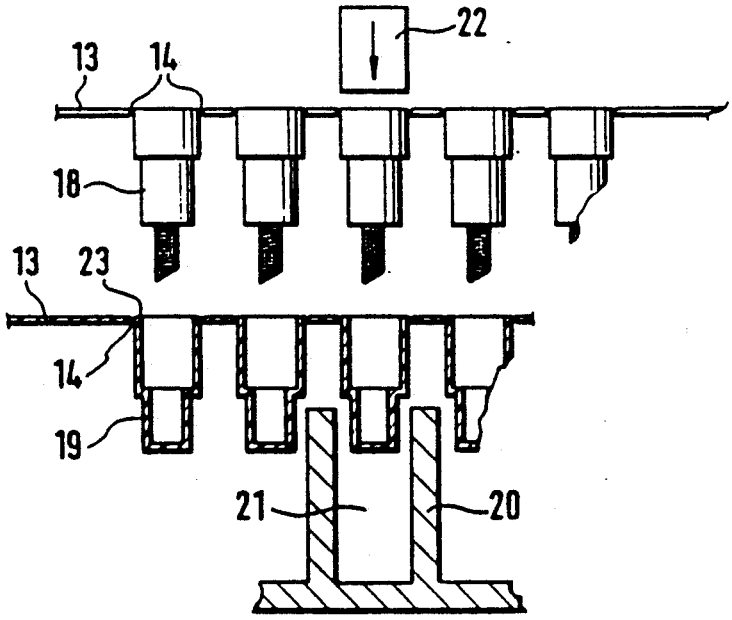
FIG. 3 shows how the inventive system may be assembled.

FIG. 3 shows how the group of pieces 18 is joined with the group of pieces 19.

The arrangement can be guided in a support 20 containing 64 cavities 21. An equal number of plungers 22 will separate and individualize the finished systems.

Prior to the assemblage of the two parts of the system, one can apply a layer of pressure-sensitive adhesive to the surface 23 of the molded arrangement of the group of pieces 19.

In this manner, each system will be individually tightened by the pressure-sensitive adhesive film which is placed between the circumference 23 of piece 5 and the circumference of the abutment rim 24 of piece 1.

The pressure-sensitive adhesive permits a plurality of openings and closures of the systems to be performed, ensuring that the tightness will be the same.

The present invention is, of course, in no way restricted to the specific disclosure of the specification and drawing, but also encompasses any modifications within the scope of the appended claims.

What I claim is:

1. A conditioning system for very small doses of make-up, comprising:

a base part comprising a tubular portion of enlarged diameter and a guide portion, said guide portion having an applicator portion, with said make-up being deposited on said applicator portion; and a cover part that is separable from and attachable to said base part for covering said applicator portion, and comprising a tubular portion, with said cover part being a combined cover and handle part that further comprises a reduced diameter portion having an outer diameter, with said tubular portion of enlarged diameter having a cavity distal from said applicator portion, said cavity having an inner diameter that is adapted to receive said outer diameter of said reduced diameter portion of said combined cover and handle part.

2. A conditioning system according to claim 1, in which said reduced diameter portion of said combined cover and handle part has an inner diameter adapted to receive said applicator portion of said base part, and has an inner length adapted to receive said applicator portion.

3. A conditioning system according to claim 1, in which said reduced diameter portion of said combined cover and handle part has a slightly conical outer surface which is adapted to be received in said tubular portion of enlarged diameter of said base part.

4. A conditioning system according to claim 1, in which said cavity of said tubular portion of enlarged diameter has a slightly conical shape adapted to receive and to tightly support said reduced diameter portion of said combined cover and handle part.

5. A conditioning system according to claim 1, in which said guide portion of said base part is slightly conically shaped in order to form a guide surface for said tubular portion of said combined cover and handle part in a closed position of said system.

6. A conditioning system according to claim 1, in which said tubular portion of said combined cover and handle part has a slightly conical inner surface adapted to receive said guide portion of said base part.

7. A conditioning system for very small doses of make-up, comprising:

a base part comprising a tubular portion of enlarged diameter and a guide portion, said guide portion being adapted to carry an applicator portion, with said make-up being deposited on said applicator portion; and a cover part that is separable from and attachable to said base part for covering said applicator portion, and comprising a tubular portion, with said cover part being a combined cover and handle part, said tubular portion of which has an outer diameter and an outer surface, with said combined cover and handle part further comprising a reduced diameter portion that is adapted to be inserted into said tubular portion of enlarged diameter of said base part in order to form a conditioning system in an open position, with said outer surface of said tubular portion forming an extension of an outer diameter or surface of said tubular portion of enlarged diameter of said base part, with said extension providing means for preventing a person's fingers from becoming soiled during handling by forming an enlarged handle portion.

8. A conditioning system according to claim 7, in which said reduced diameter portion of said combined cover and handle part has an inner diameter adapted to receive said applicator portion of said base part, and has an inner length adapted to receive said applicator portion.

9. A conditioning system according to claim 7, in which said reduced diameter portion of said combined cover and handle part has a slightly conical outer surface which is adapted to be received in said tubular portion of enlarged diameter of said base part.

10. A conditioning system according to claim 7, in which said tubular portion of enlarged diameter has a cavity having a slightly conical shape adapted to receive and to tightly support said reduced diameter portion of said combined cover and handle part.

11. A conditioning system according to claim 7, in which said guide portion of said base part is slightly conically shaped in order to form a guide surface for said tubular portion of said combined cover and handle part in a closed position of said system.

12. A conditioning system according to claim 7, in which said tubular portion of said combined cover and handle part has a slightly conical inner surface adapted to receive said guide portion of said base part.

13. In a conditioning arrangement for make-up, said conditioning arrangement comprising a base part and a cover part, with said base part having a base part length and said cover part having a cover part length, said base part having a guide portion and an applicator portion for receiving said make-up, said cover part having a tubular portion, with means being provided for allowing said conditioning arrangement to provide a closed position, with said cover part covering said guide portion and said applicator portion of said base part in said closed position, and having an open position, the improvement wherein:

means are provided for generating an enlarged handle portion and comprise said cover part, as a combined cover and handle part, which via said tubular portion thereof forms an extended handle portion protruding from said base part, said base part having a tubular portion of enlarged diameter with a cavity, and said combined cover and handle part having a reduced diameter portion, with said cavity being adapted to receive said reduced diameter portion in said open position of said arrangement.

14. A conditioning arrangement according to claim 13, in which said make-up coats an applicator head having a specific shape, with means being provided that limit the drying-up of volatile products until time of use, said means comprising a compartment in said reduced diameter portion that is adapted to said specific shape, thus reducing the amount of air surrounding said applicator head in the closed position.

15. A conditioning arrangement according to claim 13, in which said applicator portion that is to carry a quantity of conditioning product has a shape that is adapted to the specific function so that it may be dip-coated with a thin, uniformly distributed film.

16. A conditioning arrangement according to claim 13, in which means are provided for preventing the fingers of a user from becoming soiled during handling of said arrangement, said means comprising: a combination of said tubular portion of enlarged diameter of said base part, said tubular portion of said combined cover and handle part, with said tubular portion having an outer diameter that is essentially the same as said enlarged diameter, and with said reduced diameter portion being adapted to be inserted into said tubular portion of enlarged diameter in said open position, and of said guide portion of said base part, which has an outer diameter smaller than said enlarged diameter.

17. A conditioning arrangement according to claim 13, in which means are provided for limiting drying-up of volatile conditioning products until time of use, said means being realized by a pressure-sensitive adhesive disposed between adjacent portions of said base part and said cover part.

18. A conditioning arrangement according to claim 13, in which means are provided for manufacturing said systems in large groups, with pieces of said systems remaining in groups during various manufacturing steps and for being separated only at the end of a manufacturing cycle.

* * * * *